US010806279B2

(12) United States Patent
Berney et al.

(10) Patent No.: US 10,806,279 B2
(45) **Date of Patent: *Oct. 20, 2020**

(54) PILLOW WITH ADJUSTABLE SLEEVE FOR INFLATABLE AIR BLADDER

(71) Applicants: Robert Berney, Centereach, NY (US); Edward Mikell, Commack, NY (US)

(72) Inventors: Robert Berney, Centereach, NY (US); Edward Mikell, Commack, NY (US)

( * ) Notice: Subject to any disclaimer, the term of this patent is extended or adjusted under 35 U.S.C. 154(b) by 192 days.

This patent is subject to a terminal disclaimer.

(21) Appl. No.: 15/783,758

(22) Filed: Oct. 13, 2017

(65) Prior Publication Data

US 2019/0110617 A1 Apr. 18, 2019

(51) Int. Cl.

| | |
|---|---|
| ***A47G 9/10*** | (2006.01) |
| ***A47G 9/02*** | (2006.01) |
| ***A47C 7/38*** | (2006.01) |

(52) U.S. Cl.

CPC ..... *A47G 9/1027* (2013.01); *A47G 9/0253* (2013.01); *A47G 9/1081* (2013.01); *A47C 7/383* (2013.01); *A47G 2009/1018* (2013.01)

(58) Field of Classification Search

CPC ..... A47G 9/10; A47G 2009/1018; A47G 9/1027; A47G 9/1081; A47G 9/0253; A47C 7/38; A47C 7/383

USPC ..... 5/644, 636, 639, 640, 645, 490

See application file for complete search history.

(56) References Cited

U.S. PATENT DOCUMENTS

| | | | | |
|---|---|---|---|---|
| 655,087 | A | 7/1900 | Jones | |
| 2,896,227 | A * | 7/1959 | Reed | A47C 27/081 5/644 |
| 2,942,281 | A | 6/1960 | Cole | |
| 3,251,075 | A | 5/1966 | Saltness et al. | |
| 3,568,227 | A | 3/1971 | Dunham | |
| 3,840,918 | A | 10/1974 | Shave | |
| 3,842,453 | A | 10/1974 | Redfield | |
| 4,501,034 | A | 2/1985 | Greenawalt | |
| 4,563,785 | A * | 1/1986 | Samelson | A47G 9/10 112/475.08 |
| 4,754,513 | A | 7/1988 | Rinz | |
| 4,768,248 | A | 9/1988 | O'Sullivan | |
| 4,829,614 | A | 5/1989 | Harper | |
| 4,908,894 | A * | 3/1990 | Sanders | A47G 9/10 5/640 |
| 4,916,765 | A | 4/1990 | Castronovo, Jr. | |
| 4,956,886 | A * | 9/1990 | Sarkozi | A47G 9/10 5/636 |
| 4,979,249 | A | 12/1990 | Meade, II | |

(Continued)

*Primary Examiner* — Robert G Santos

(74) *Attorney, Agent, or Firm* — Alfred M. Walker; John F. Vodopia

(57) ABSTRACT

A support pillow has a pillow-fill unit comprising pillow fill material, a neck support unit comprising an inflatable air bladder and a pillow case having a first sleeve for receiving the pillow-fill unit and a second sleeve for receiving the cervical or neck support unit. The second sleeve of the pillow case includes padding on an inner sleeve surface. The inflatable air bladder includes a valve that operates in a first state to allow an input of pressurized air and in a second state to allow an exit of bladder-stored air. Adding air to the inflatable air bladder, in the first state, increases a size of and pressure in the inflatable air bladder. Also, the padding on the inner sleeve surface of the second sleeve is soft, and compressible.

11 Claims, 6 Drawing Sheets

(56) References Cited

U.S. PATENT DOCUMENTS 4,984,315 A 1/1991 Ortman et al.
5,020,174 A * 6/1991 Sarkozi ..... A47G 9/10 5/640
5,022,109 A 6/1991 Pekar
5,068,933 A 12/1991 Sexton
5,412,822 A 5/1995 Kelly
5,586,350 A * 12/1996 Thonnessen ..... A47C 31/001 5/636
5,771,514 A 6/1998 Wilhoit
5,898,963 A 5/1999 Larson
6,047,425 A 4/2000 Khazaal
6,131,219 A 10/2000 Roberts
6,151,733 A 11/2000 Takashima
6,175,978 B1 1/2001 Nizzi et al.
6,327,725 B1 12/2001 Veilleux et al.
6,490,743 B1 12/2002 Adat et al.
6,951,038 B1 10/2005 Ganoe, Sr.
6,952,848 B1 10/2005 Strunk-Fellows
7,222,379 B2 5/2007 DiGirolamo
7,318,244 B1 1/2008 Kasatshko
7,328,472 B2 2/2008 Chaffee
7,383,599 B2 6/2008 Gabbay
7,513,002 B2 * 4/2009 Best ..... A47G 9/1027 5/636
7,530,127 B2 * 5/2009 Leifermann ..... A47G 9/1081 5/490
7,644,459 B1 1/2010 Olson
7,707,744 B2 5/2010 Schindler et al.
7,832,034 B2 * 11/2010 Liu ..... A47G 9/10 5/490
8,205,282 B2 6/2012 Brogan et al.
8,245,339 B2 8/2012 Murray et al.
8,434,177 B2 5/2013 Chaffee
8,656,537 B2 2/2014 Leifermann et al.
8,782,834 B2 * 7/2014 Berg ..... A47G 9/1027 5/639
D728,271 S 5/2015 Cohen
9,101,234 B2 * 8/2015 Berg ..... A47G 9/1027
9,138,339 B2 9/2015 Castrale et al.
9,226,605 B1 1/2016 Castellano
9,247,836 B2 2/2016 DuPre
D752,360 S 3/2016 Hadley
9,352,800 B2 5/2016 Brown
9,737,153 B2 8/2017 Chaffee
2007/0044239 A1 * 3/2007 Leifermann ..... A47G 9/1081 5/636
2007/0174970 A1 * 8/2007 Best ..... A47G 9/1027 5/644
2010/0077551 A1 * 4/2010 Liu ..... A47G 9/0253 5/636
2011/0061166 A1 * 3/2011 Liu ..... A47G 9/0253 5/636
2012/0036642 A1 * 2/2012 Brogan ..... A47G 9/1081 5/644
2013/0269111 A1 * 10/2013 Berg ..... A47G 9/1027 5/644
2014/0325762 A1 * 11/2014 Berg ..... A47G 9/1027 5/644
2019/0110617 A1 * 4/2019 Berney ..... A47G 9/1027

* cited by examiner

Fig. 1
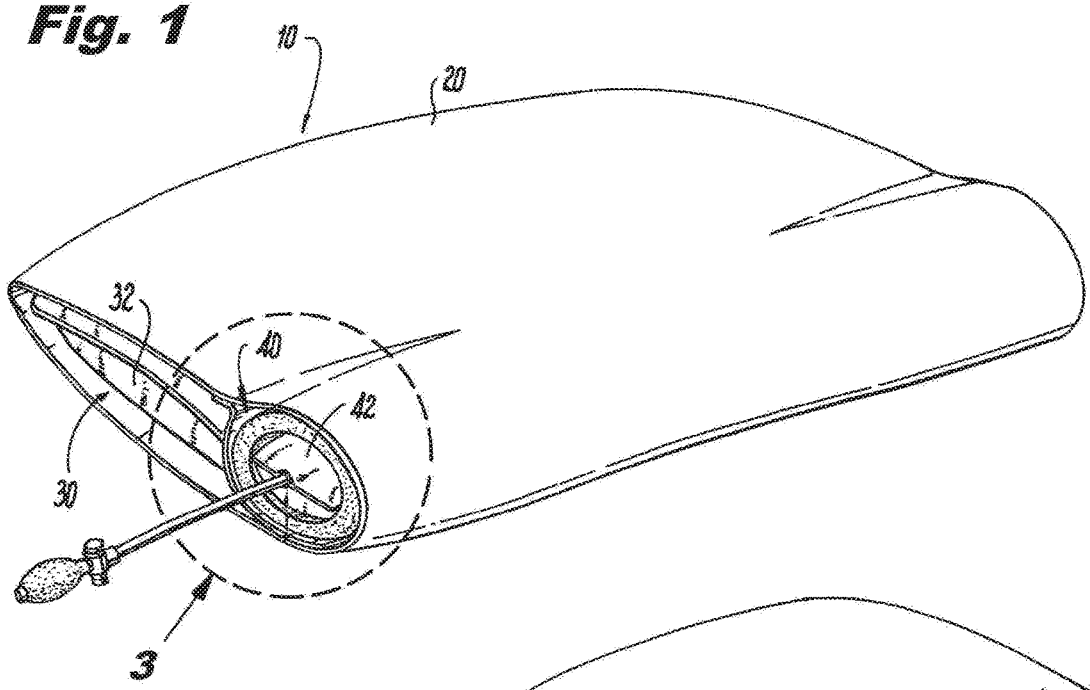
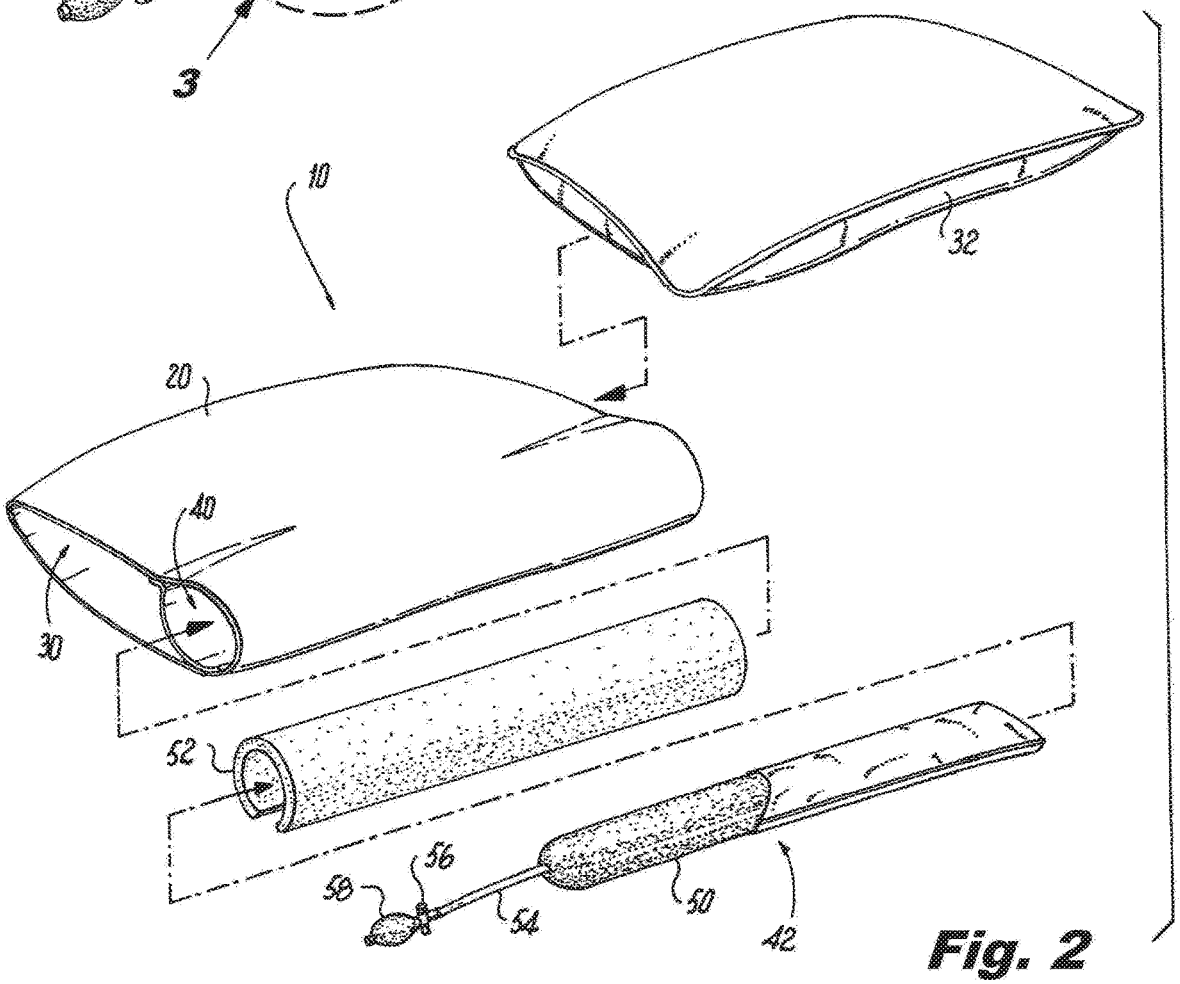
Fig. 2

PILLOW WITH ADJUSTABLE SLEEVE FOR INFLATABLE AIR BLADDER

BACKGROUND OF THE INVENTION

The invention relates to a neck support pillow and more particularly, to a support pillow formed with a pillow case having a first sleeve for receiving pillow filling, or a unit of pillow filling and a second sleeve for receiving a cervical or neck support portion, such as an inflatable air bladder, for adjusting the dimensions and the firmness of the cervical or neck-support portion.

Pillows with cervical support portions are known. For example, U.S. Pat. No. 655,087 of Jones discloses a pillow with a case 1 within which, near to one of the long borders or edges of the case, is secured a longitudinally extending strip or diaphragm 1 of ticking or equivalent material, so as to form at the border or edge of the pillow tubular chamber or receptacle 1b, into which is inserted a tube 3, formed by suitable elastic or flexible and fluid tight material, with a valve 3a as employed with pneumatic tires, for inflation with air; see FIG. 2. There is no padding, so the bladder directly under the case material tends to irritate the user's neck and/or head.

U.S. Pat. No. 2,942,281 of Cole discloses a pillow or cushion with a cloth covering 5 filled with a filler material 6 and a flexible pneumatic member or bag 7 that is inflated with air to vary the bulk and the firmness of the pillow. A flexible pneumatic member or bag 7 is positioned within the filler material, and while adding air thereto increases the firmness of the flexible pneumatic member or bag 7, and therefore, the pillow, there is no separate sleeve for the pillow filler material 6 and the flexible pneumatic member or bag 7, particularly not so that the pillow provides for neck or cervical support using a separate portion of the pillow.

U.S. Pat. No. 4,501,034 to Greenawalt discloses a composite pillow including one or more elements for receiving the neck or cervical region of a person lying on the pillow and another adjacent element for receiving the person's head. FIGS. 1-6 show the composite pillow comprising 3 separate elements or portions 10, 12 and 14, laminated together in a known fashion at junctures 13 and 15. Element 10 includes filler, but sections 12 and 14 may include air bladders 32 and 24, that appear to extend for part of the width of the pillow, between wall portions 36 in part 12 and end-to-end sections 16, 20, 16' in section 14 of FIGS. 6 and 7.

U.S. Pat. No. 4,754,513 to Rinz discloses a pillowcase and an insert for converting a conventional pillow into an orthopedic pillow. The orthopedic pillow has a pillowcase 10 with a pocket secured to an inside of the pillowcase for receiving a soft (compressible), resilient, elastomeric insert. FIG. 1 shows that pillowcase 10 comprises spaced panels 9 having long and short sides, that are joined by sewing along both sides 13a, 13b and on short side 14a. A pocket 15 is formed on an inside of one panel 9, for receiving and carrying an insert 16 to be used in combination with the conventional pillow 17. The insert is about 17 to 19 inches long and is made of elastomeric material.

U.S. Pat. No. 4,829,614 of Harper discloses an adjustable pillow and neck support portion 10; see FIGS. 1-3. The adjustable pillow and neck support portion 10 has an integral body 12 with a main part 14 and neck support part 16, covered with a cover 18 with an opening 19 closed by a closure member or zipper 20. Inflatable members 22, 24, 26 and 28, as shown, are removably positioned in the main part 14 and neck support part 16, respectively. While the adjustable pillow and neck support portion 10 includes a block of pillow support material, and tubes for receiving the inflatable members, there is no separate sleeve part.

U.S. Pat. No. 5,771,514 of Wilnolt discloses an adjustable contour pillow 10 with a control system 12, a resilient cushion 14 which surrounds a first 16, second 18 and third 20 selectively inflatable chamber. The three chambers are separate, adjacent, parallel elongate tubes of equal length and are laterally disposed to extend the entire width of the pillow, essentially defining a generally rectangular platform. The tubes are not found in a section or sleeve that is separate from that of the pillow filler portion.

U.S. Pat. No. 6,131,219 of Roberts discloses an inflatable pillow 10 with an air-impervious flexible bladder 11 (having recessed areas 12, 13 in its opposite ends and a cervical support portion 14 of increased thickness (see FIGS. 1-3). The cervical support portion 14 includes a separate inflatable chamber that is thicker than the body part 15. Essentially, the pillow 10 comprises two bladders, which present a constant pressure. Because the bladders are under pressure, with no padding, they can be quite uncomfortable, as the user's head and neck likely do not effect compression as would a pillow section with filler material.

U.S. Pat. No. 6,952,848 of Strunk-Fellows discloses a cervical pillow 10 with a casing 11, a pillow-filling 12 and a cervical support member 13 disposed therein. There is no separate sleeve for cervical support member 13, 22, only a chamber. The cervical support members appear to be foam, and are seen to comprise an adjustable, inflatable air bladder U.S. Pat. No. 9,247,836 of DuPre discloses a configurable pillowcase with a compartment for at least one removable insert. For example, FIG. 1 therein show pillow case 10 with a housing 12-1 of size A and internally disposed primary compartment 12-2, accessible through opening 14, and a secondary compartment 16 of size B positioned on the pillow case housing 12-1 top surface at distances D1, D2, for outer edges thereof, for receiving inset component 20 of a size C. The insert component 20, however, appears to be central to the pillowcase; see FIGS. 2A and 2B, and do not appear to be directed to providing pressure to the neck of a user resting or lying the users neck and/or head thereon.

SUMMARY OF THE INVENTION

The present invention overcomes the shortcomings of known arts, such as those mentioned above. The invention provides for a support pillow, including a pillow-fill unit comprising pillow fill material; a neck support unit comprising an inflatable air bladder; and a pillow case having a first sleeve for receiving the pillow-fill unit and a second sleeve for receiving the cervical or neck support unit, wherein the second sleeve of the pillow case includes padding on an inner sleeve surface. The inflatable air bladder includes a valve that operates in a first state to allow an input of pressurized air and in a second state to allow an exit of bladder-stored air; wherein adding air to the inflatable air bladder, in the first state, increases a size of and pressure in the inflatable air bladder. The padding on the inner sleeve surface of the second sleeve is soft, and compressible, with a loft ability to return to an uncompressed state.

The padding on the inner sleeve surface of the second sleeve is resilient, and is made of particles and/or layers of an elastomeric material constituting a pillow fill material, preferably defining a thickness of the inner sleeve between ½ inch and 2 inches.

The air bladder valve includes a squeeze ball to input the pressurized air, and includes an air tube extending from a valve connection to the inflatable air bladder, to a tube connection to the squeeze ball. For safety reasons to prevent infant or toddler choking, the maximum length of the tubing is six inches. Optionally, the tube and the squeeze ball, can be stored in the second sleeve during use or non-use.

The second sleeve for the air bladder can be formed integrally at part of the pillow case, and is optionally pivotable about the first sleeve holding the main pillow therein. As a further option, the second sleeve can, in some circumstances, be detachably connected to the first sleeve.

Optionally, the pillowcase and associated sleeve are opened at both side ends, so that larger different sized pillows can be inserted, where the extra side length of the inserted pillow (such as a "King" size pillow) can extend out the opposite side of the pillowcase from which it was inserted. In another option, the pillow case can be closed-ended at the opposite side.

BRIEF DESCRIPTION OF THE DRAWINGS

Further features and advantages of the invention will become apparent from the description of embodiments that follows, with reference to the attached figures, wherein:

FIG. 1 is a perspective view of an embodiment of a support pillow with a padded inflatable air bladder of the invention;

FIG. 2 is an exploded perspective view of the embodiment of FIG. 1, showing a first double open ended sleeve for insertion of a pillow therein, and a cutaway view of the padding surrounding the inflatable air bladder, where the directional arrow shows the direction of insertion of the padded air bladder into a second sleeve.

FIG. 3 is taken along view circle view line "3" of FIG. 1.

DETAILED DESCRIPTION OF THE PREFERRED EMBODIMENTS

Figure 3:
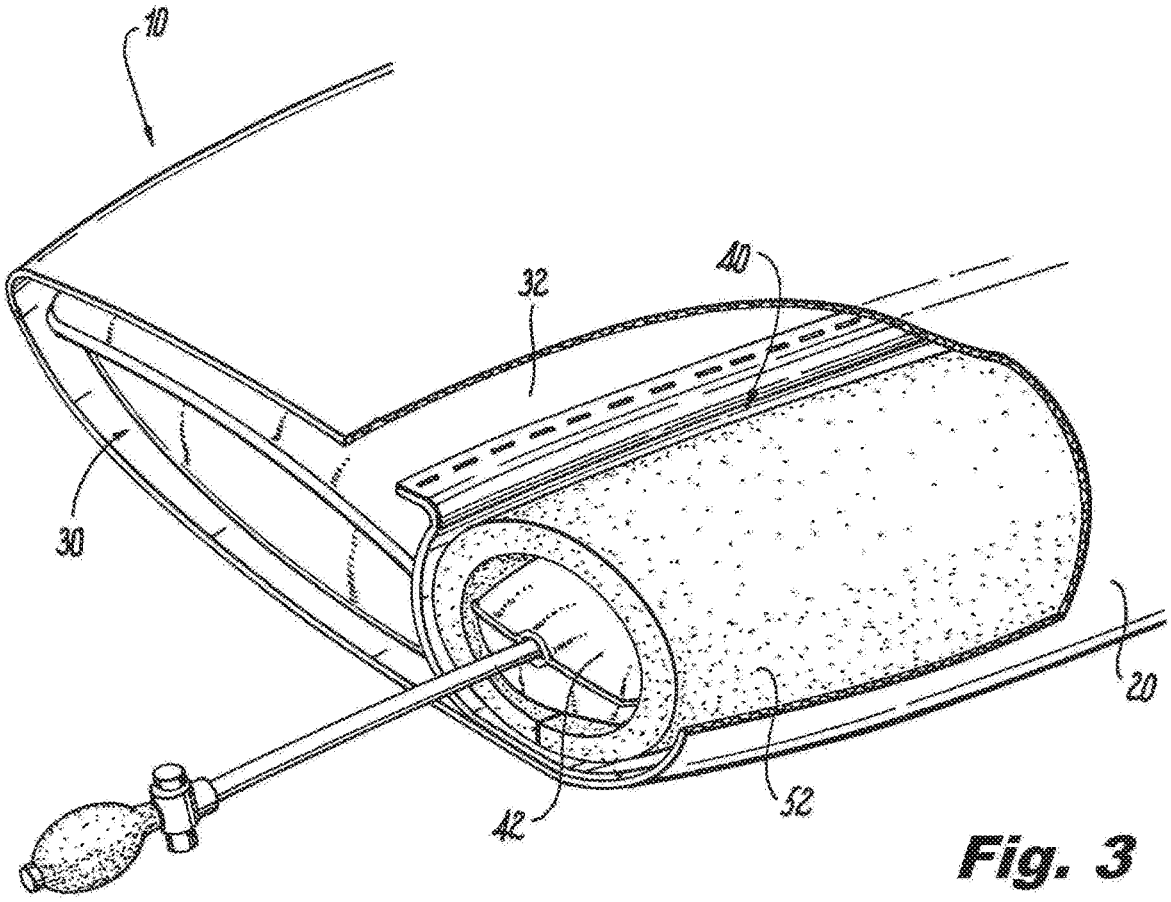
FIG. 3 is a close-up detail view in partial cross section of the pillow, revealing inflatable air bladder, where

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

FIGS. 1-3 and 6 show one embodiment of a support pillow 10, of the invention. The support pillow comprises a pillow case 20 having a first sleeve 30 for receiving a conventional pillow-fill unit 32 and a second sleeve 40 for receiving the cervical or neck support unit 42. The pillow case 20 is preferably 31 inches long and 19 inches wide, where the first sleeve 30 is 11½ inches wide the second sleeve is 7% inches long.

FIGS. 2 and 3 depict the pillow unit 32 and the neck support unit 42. The neck support unit 42 preferably comprises an inflatable air bladder 50 that is 5 inches in diameter, and is enveloped by a padding or cushion layer 52. The padding or cushion layer 52 is at least ½-inch-thick, and preferably 1½ inches thick. While the padding or cushion layer 52 is depicted as being formed on an inner surface of the second sleeve 40, the padding or cushion layer 52 also could be arranged about the outer surface of the cervical or neck support unit 42. As shown in FIGS. 2 and 3, the padding or cushion layer 52 of second sleeve 40 of the pillow case 20 is a hollow tubular resilient cushioned padding layer loosely positioned on an inner sleeve surface of the second sleeve 40, wherein the hollow tubular resilient cushioned padding layer 52 in said second sleeve 40 is separated apart from the pillow fill unit 32 in the first sleeve 30.

While first sleeve 30 may be a closed ended sleeve open at one distal end and closed at the opposite proximal end, FIG. 2 shows that first sleeve 30 may be optionally open on both opposite ends to accommodate different sized pillows 32 therein. Therefore a pillow 32 larger than first sleeve 30 will extend outward through the opposite open end of first pillow sleeve 30.

As shown in FIG. 2 the padding 52 on the inner sleeve surface of the second sleeve 40 is preferably resilient. Most preferably, the resilient padding 52 is made of a soft recovering material. Alternatively, the padding on the inner sleeve surface of the second sleeve can be formed with a visco-elastic foam (VEF), an elastomeric material, or pillow fill material such as feather down, wool, cotton or synthetic fabric materials in layers or particulates, such as rayon polyester, gel fibers, or polyurethane or blends thereof in combination. The padding requires a fill power to retain "softness" in resuming padding height. The preferred pillow fill material defines a thickness of the inner sleeve surface that is between ½ inch and 2 inches.

The inflatable air bladder 50 is shown in detail in FIG. 2, including a tube 54, which is a maximum of 6 inches, but not limited in shorter lengths. The tube cannot exceed six inches in length pursuant to safety standards for preventing choking of infants and small children The inflatable air bladder is preferably made of an inflatable, stretchable material, such as, for example natural rubber sold under the brand name NEOPRENE®. The inflatable air bladder is preferably covered with a soft expandable fabric, such as nylon. Preferably, the inflatable air bladder 50 includes a valve 56 that allows air to be input to the inflatable air bladder 50, to increase its size and internal air pressure, or allow air to be released from the inflatable air bladder 50, to decrease its size and internal air pressure. In one form, the valve allows for a user to use their mouth to increase the internal pressure and in another form the valve includes a squeeze ball or bulb 58 to add or extract air.

Figure 4:
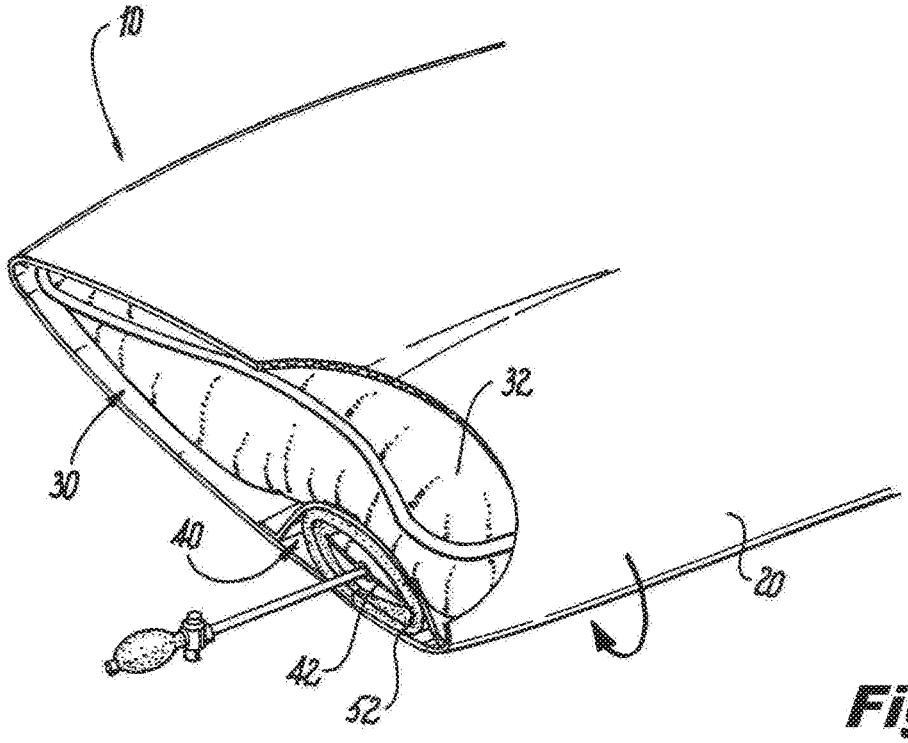
FIG. 4 is a close-up detail view of the embodiment of FIG. 1, with the directional arrow showing rotation of the circumference of the pillow and inflatable air bladder.
Figure 5:
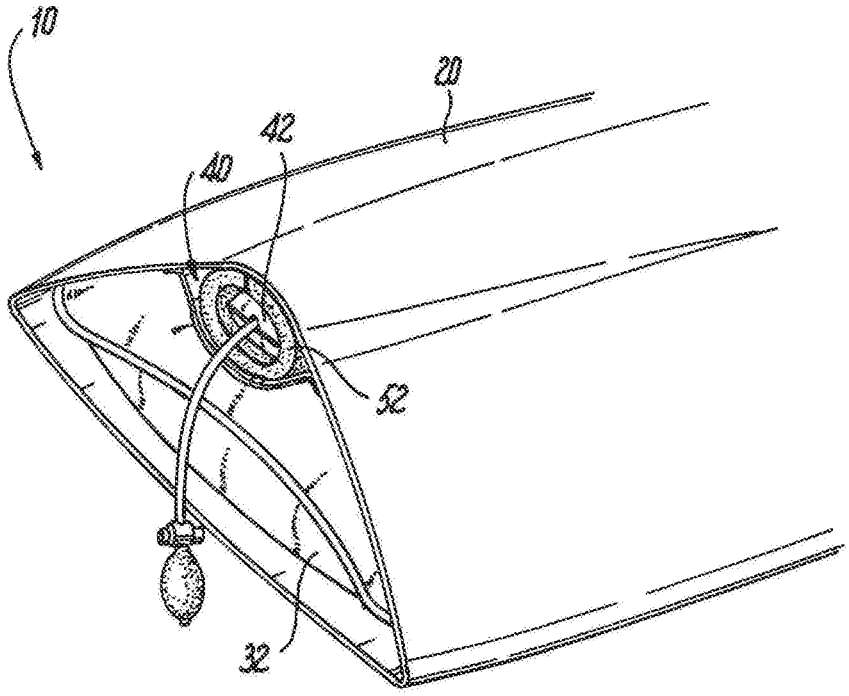
FIG. 5 is a close-up detail view of the pillow as in FIG. 4, where the inflatable air bladder is centrally located at the top of the pillow for use under the knee or lower back of the user, where the pillow supports other body parts besides the neck, such as the knees or lumbar spine, by rotating the pillow case so that the padded sleeve with the air bladder is not at the side edge, but rather elevated in the middle.
Figure 6:
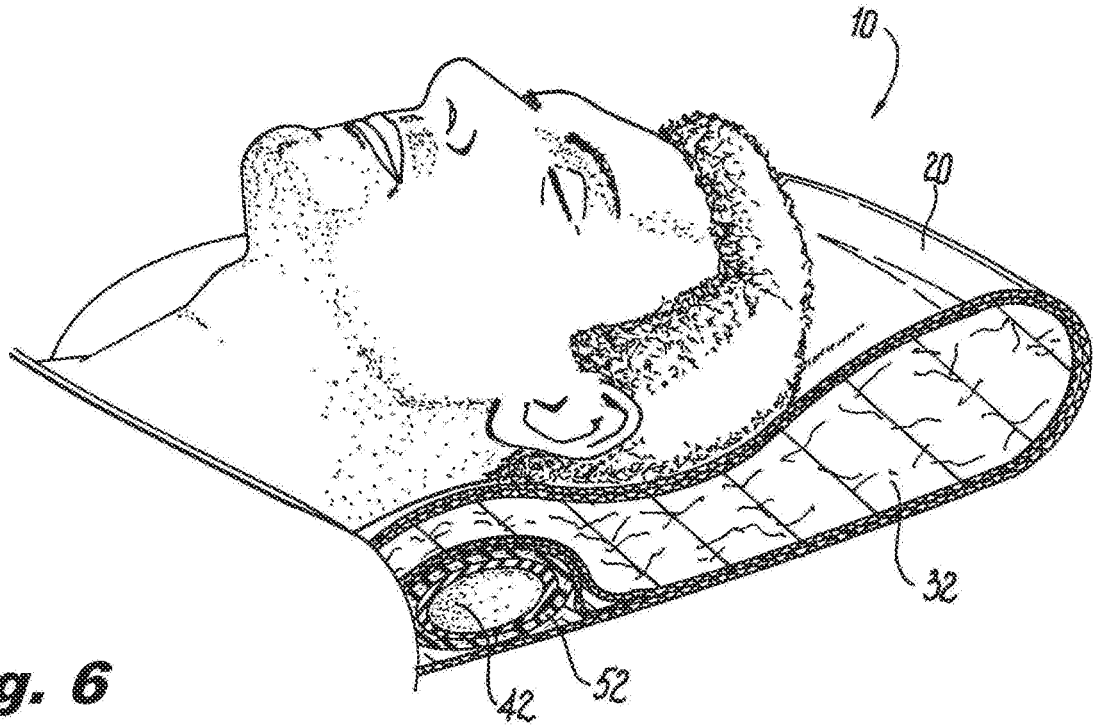
FIG. 6 is a perspective view showing a user resting the cervical neck spine thereon.

FIGS. 4 and 5 show use of the pillow 10 for supporting other body parts besides the neck, such as the knees or lumbar spine, by rotating the pillow case 20 so that the padded sleeve 40 with the air bladder 42 is not at the side edge, but rather elevated in the middle.

Figure 7:
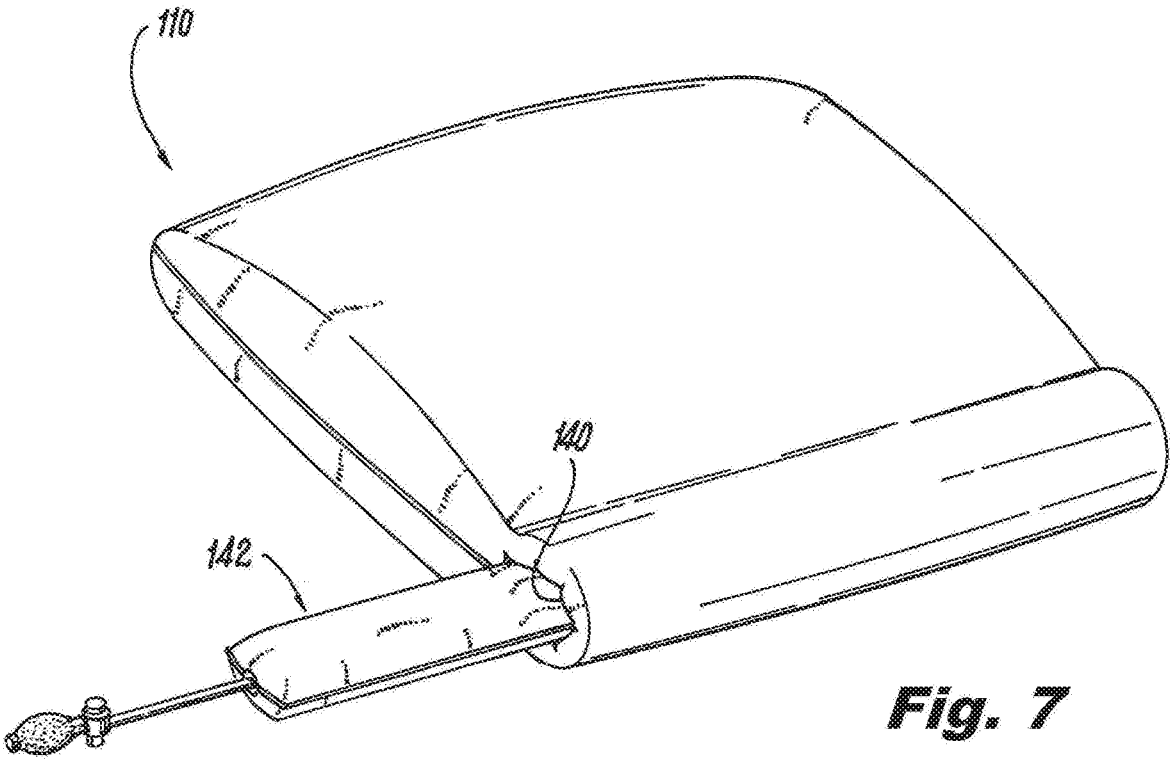
FIG. 7 is an exploded perspective view of an alternate embodiment where the pillow is provided integral with a pocket for the inflatable air bladder.
Figure 8:
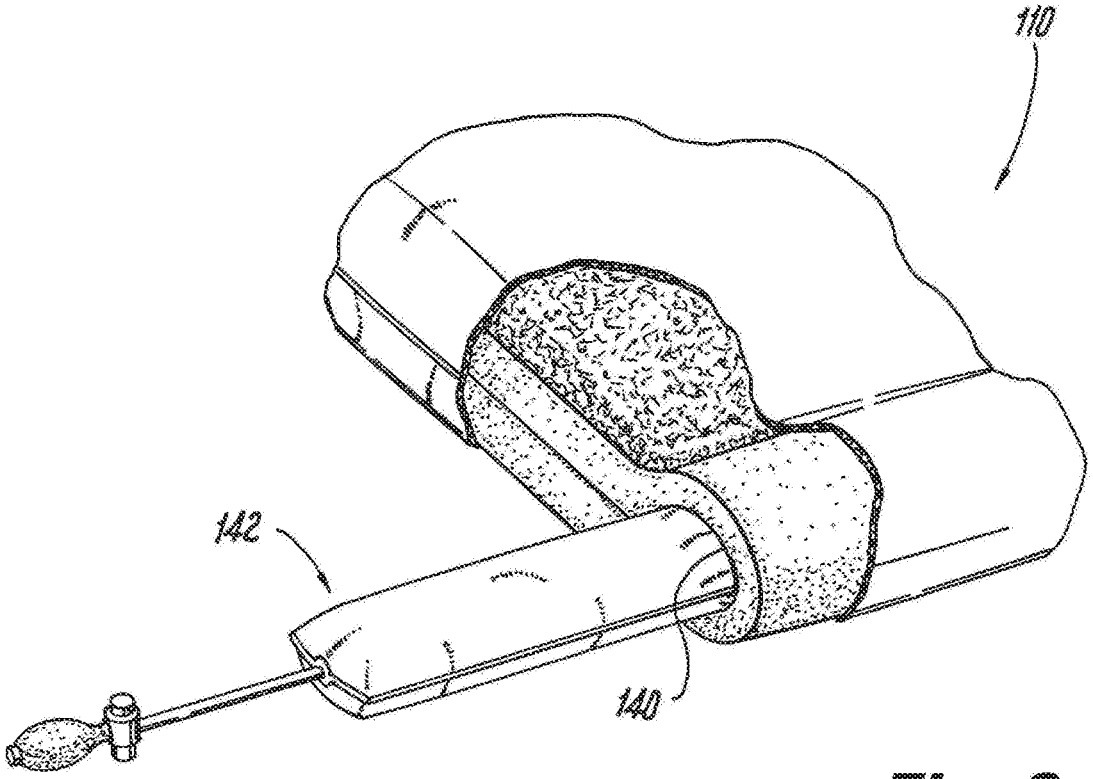
FIG. 8 is a close-up detail of the pillow of FIG. 7 in partial cross section revealing pillow batting and a padded sheath around the inflatable air bladder.

FIGS. 7 and 8 show an alternate embodiment where instead of the pillow being inserted in a first sleeve of a pillowcase, the pillow 110 itself has an integral second padded sleeve 140 for supporting the air bladder 142 therein.

Figure 9:
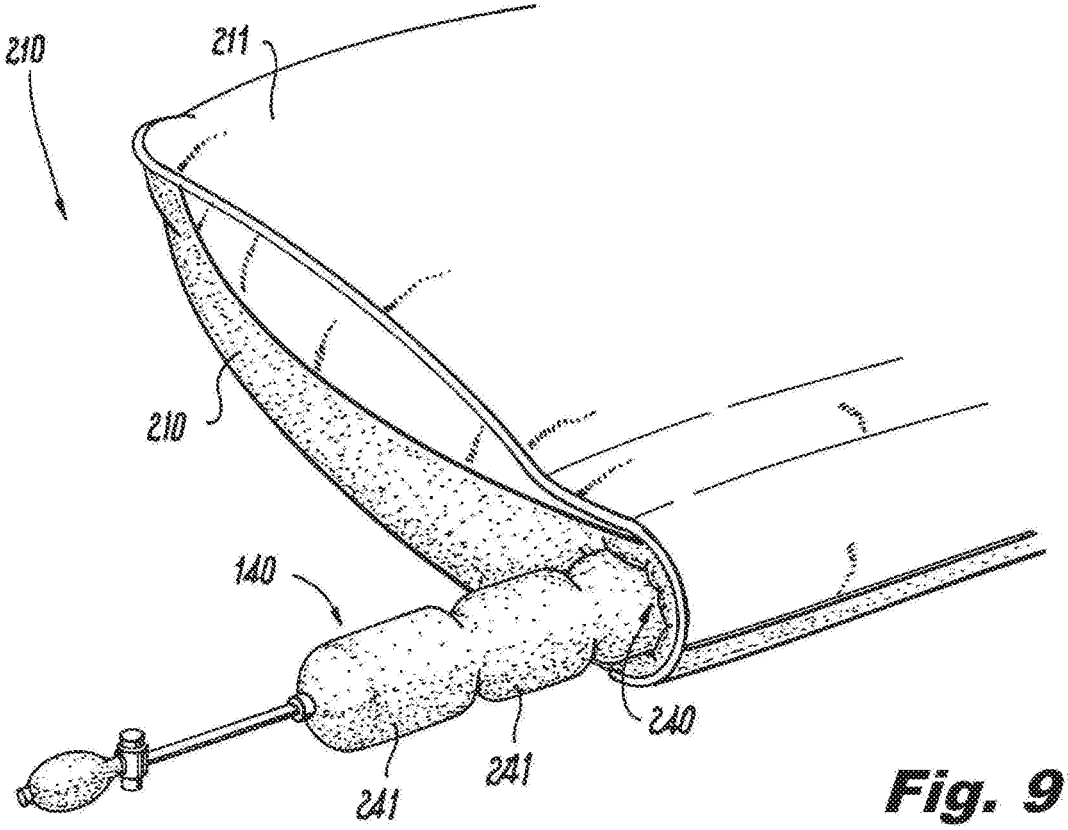
FIG. 9 is a perspective view showing an optional segmented bladder in a climate controlled pillow with hot and cold half segments.

FIG. 9 shows an air bladder sleeve 240 attached to a climate controlled pillow 210 with warm and cool sections, 211 and 212, where optionally the air bladder 140 is shown segmented into segments 241.

Figure 10:
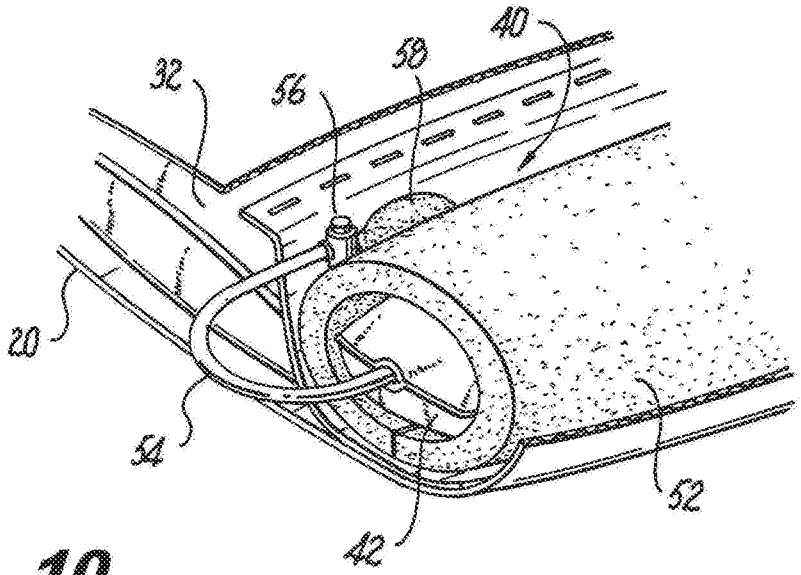
FIG. 10 is a close-up detail view for a further alternate embodiment where the squeeze bulb is stored within the second sleeve for the inflatable air bladder.

Preferably, as shown in the alternate embodiment of FIG. 10 the valve, including the tube 54 and the squeeze ball 58, are stored after use, in the second sleeve 40 during non-use.

Figure 11:
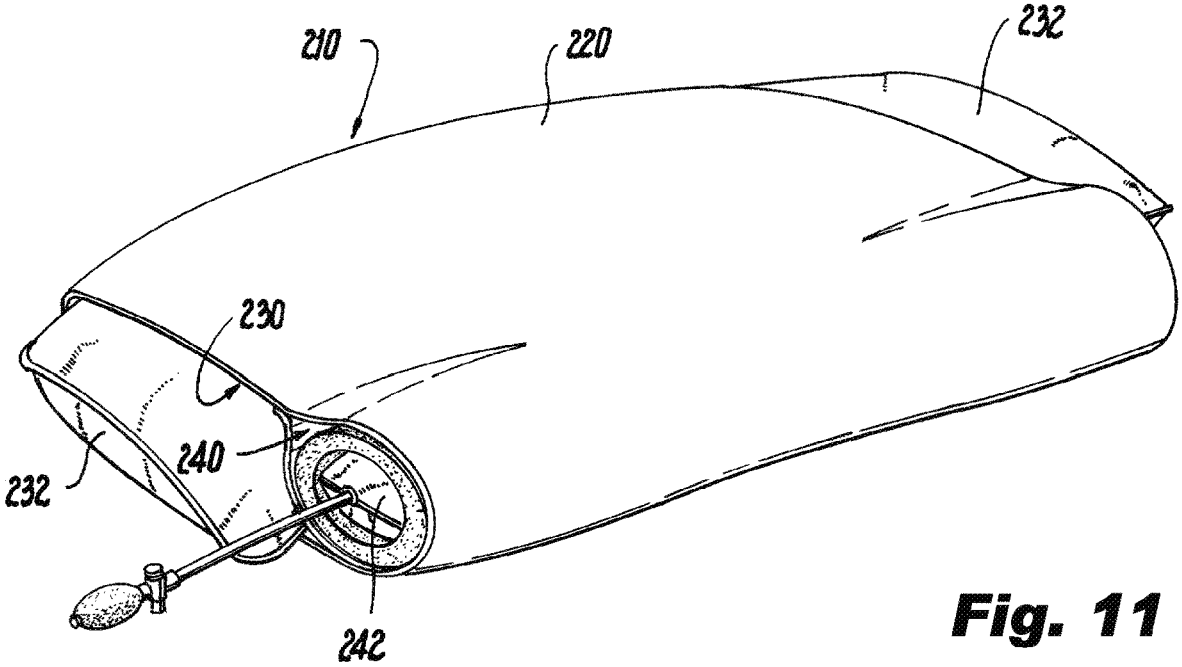
FIG. 11 is a perspective view of an alternate embodiment of a support pillow with a padded inflatable air bladder of the invention, where the pillowcase and associated sleeve are opened at both side ends, so that larger, different sized pillows can be inserted, where the extra side length of the inserted pillow (such as a "King" size pillow) can extend out the opposite side of the pillowcase from which it was inserted.

As shown in FIG. 11, the pillowcase 210 and associated sleeve 220 are opened at both side ends, so that larger different sized pillows 232 can be inserted within hollow sleeve 230, where the extra side length of the inserted pillow 232 (such as a "King" size pillow) can extend out the opposite side of the pillowcase 220, from which it was inserted. FIG. 11 also shows inflatable neck support unit 242 inserted within smaller hollow sleeve 240.

Optionally, in the alternate embodiment, the valve, including the tube 54 and the squeeze ball 58, are maintained inside the second sleeve 40 during both use and non-use and wherein to add air, the user either reaches in to squeeze the squeeze ball 58 or alternatively applies a pushing force against a part of an outer surface of the second sleeve 40 directly under which is the squeeze ball 58.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A support pillow, comprising:

a pillow-fill unit comprising pillow fill material;

a neck support unit comprising an inflatable air bladder; and a pillow case having an outer surface, a first sleeve for receiving the pillow-fill unit and a second sleeve for receiving the neck support unit;

wherein the first sleeve and the second sleeve are covered by the outer surface of the pillow case;

wherein the second sleeve includes a hollow tubular resilient cushioned padding layer loosely positioned on an inner sleeve surface thereof; wherein the padding layer on the inner sleeve surface of the second sleeve is soft, and compressible wherein said hollow tubular resilient cushioned padding layer defines a thickness of the inner sleeve surface that is between ½ inch and 1½ inches in thickness, said second sleeve totally enveloping said hollow resilient cushioned padding layer and said second sleeve being separated apart from said pillow-fill unit in said first sleeve;

wherein the inflatable air bladder includes a valve that operates in a first state to allow an input of pressurized air and in a second state to allow an exit of bladder-stored air;

wherein adding air to the inflatable air bladder, in the first state, increases a size of and pressure in the inflatable air bladder.

2. The support pillow of claim 1, wherein the hollow tubular resilient cushioned padding layer is made of viscoelastic foam (VEF) material.

3. The support pillow of claim 1, wherein the hollow tubular resilient cushioned padding layer on the inner sleeve surface of the second sleeve is formed with an elastomeric material.

4. The support pillow of claim 1, wherein the hollow tubular resilient cushioned padding layer on the inner sleeve surface of the second sleeve is formed with the pillow fill material.

5. The support pillow of claim 1, wherein the second sleeve is formed integrally at part of the pillow case.

6. The support pillow of claim 5, wherein the second sleeve is pivotable about the first sleeve.

7. The support pillow of claim 1, wherein the second sleeve is detachably connected to the first sleeve.

8. The support pillow of claim 1 wherein said pillow case and said neck support unit are rotatable about said pillow-fill unit whereby said neck support unit is rotationally positionable from a position along a bottom edge of said pillow-fill unit, to a heightened mid position along a median of said pillow-fill unit to enable heightened support under the lumbar low back or under the knees of the user.

9. The support pillow as in claim 1 wherein said pillow case has a distal side end and a proximal side end; said pillow case being opened at both said distal and said proximal side ends, so that larger, different sized pillows can be inserted, where the extra side length of a respective inserted pillow can extend out the opposite side of said pillow case from which it was inserted.

10. The support pillow as in claim 1 wherein the pillow-fill unit comprising pillow fill material is sewn into an integral pillow case.

11. A method of assembling a support pillow with a pillow case having an outer surface, and a first sleeve and a second sleeve covered by the outer surface, an inflatable air bladder and a pillow-fill unit for neck and skull treatment, comprising the steps of:

providing a pillow-fill unit with pillow-fill material;

wherein the second sleeve of the pillow case includes a hollow tubular resilient cushioned padding layer loosely positioned on an inner sleeve surface thereof;

wherein said hollow tubular resilient cushioned padding layer defines a thickness of the inner sleeve surface that is between ½ inch and 1½ inches in thickness, said second sleeve totally enveloping said hollow resilient cushioned padding layer and said second sleeve being separated apart from said pillow-fill unit in said first sleeve;

wherein the inflatable air bladder includes a valve that operates in a first state to allow an input of pressurized air and in a second state to allow an exit of bladder-stored air;

wherein adding air to the inflatable air bladder, in the first state, increases a size of and pressure in the inflatable air bladder;

providing a cervical neck support unit comprising the inflatable air bladder;

inserting said pillow-fill unit into the first sleeve of said pillow case for receiving the pillow-fill unit;

inserting said inflatable air bladder into the second sleeve for receiving the cervical neck support unit;

wherein the hollow tubular resilient cushioned padding layer loosely positioned on the inner sleeve surface of the second sleeve is soft, compressible, elastomeric and resilient;

inflating the inflatable air bladder with a squeeze ball operating a valve that operates in a first state and allowing an input of pressurized air to a desired first state of neck support;

wherein said pillow case and said cervical neck support unit are rotatable about said pillow-fill unit whereby said cervical neck support unit is rotationally positionable from a position along a bottom edge of said pillow-fill unit, to a heightened mid position along a median of said pillow-fill unit to enable heightened support under the lumbar low back or under the knees of the user;

providing a tube connection between the squeeze ball and the inflatable air bladder being a maximum of six inches in length;

storing the squeeze ball, valve and tube connection within the second sleeve during non-use; and, releasing said valve of said inflatable air bladder upon completion of a session of neck support and allowing an exit of said pressurized air.

* * * * *